US005956791A

United States Patent [19]

Bassi et al.

[11] Patent Number: 5,956,791

[45] Date of Patent: Sep. 28, 1999

[54] EPICYCLOIDAL BRUSHING SYSTEM

[75] Inventors: Luigi Bassi, Lodi; Paolo Spinzi, Milan, both of Italy

[73] Assignee: International Business Machines Corporation, Armonk, N.Y.

[21] Appl. No.: 08/950,263

[22] Filed: Oct. 14, 1997

[30] Foreign Application Priority Data

Nov. 30, 1996 [GB] United Kingdom ..... 9625025

[51] Int. Cl.[6] ..... A46B 13/00

[52] U.S. Cl. ..... 15/21.1; 15/28; 15/88.2

[58] Field of Search ..... 15/21.1, 28, 77, 15/88.2, 97.1, 29, 49.1, 87, 102

[56] References Cited

U.S. PATENT DOCUMENTS

| | | | |
|---|---|---|---|
| 2,967,315 | 1/1961 | Helbig et al. | 15/49.1 |
| 3,691,582 | 9/1972 | Call | 15/77 |
| 4,177,535 | 12/1979 | Cole | 15/97.1 |
| 4,378,610 | 4/1983 | Ermer et al. | 15/1.5 |
| 4,474,445 | 10/1984 | Wilson | 354/317 |
| 4,692,959 | 9/1987 | Monson | 15/320 |
| 4,935,981 | 6/1990 | Ohtani et al. . | |
| 4,993,096 | 2/1991 | D'Amato | 15/77 |
| 5,143,529 | 9/1992 | Means, Jr. | 55/290 |
| 5,351,360 | 10/1994 | Suzuki et al. | 15/302 |
| 5,355,542 | 10/1994 | Oreck et al. | 15/49.1 |
| 5,361,449 | 11/1994 | Akimoto . | |
| 5,375,291 | 12/1994 | Tateyama et al. | 15/302 |
| 5,685,039 | 11/1997 | Hamada et al. | 15/88.2 |
| 5,687,442 | 11/1997 | McLain | 15/29 |

FOREIGN PATENT DOCUMENTS

| | | | |
|---|---|---|---|
| 0 051 0462 | 10/1980 | European Pat. Off. . | |
| 0 549 377 A2 | 12/1991 | European Pat. Off. . | |
| 18474 | 10/1899 | Germany | 15/21.1 |
| 1168407 | 10/1969 | United Kingdom | 15/97.1 |
| 1 596 390 | 5/1981 | United Kingdom . | |

*Primary Examiner*—Robert Warden
*Assistant Examiner*—Andrew Aldag
*Attorney, Agent, or Firm*—Alison D. Mortinger; Jay H. Anderson

[57] ABSTRACT

A brushing system to be used in the manufacturing of electronic modules for removing unwanted particles from the substrate surface before the final encapsulation of the modules. The system provides an epicycloidal movement of the brush bristles on the substrate, which results in very effective in the removal of the particles. The system comprises a rotatable shaft with an eccentric bore. The hub of a rotatable brush can freely move inside the bore. When the shaft is rotated by a motor and the brush bristles are subject to friction, the brush describes an epicycloidal movement.

11 Claims, 3 Drawing Sheets

$\overline{ON}=R, \quad \overline{NC}=r, \quad \widehat{BON}=t$ $$\begin{cases} x = (R+r)\sin t - r\sin\left(\frac{R+r}{r}t\right) \\ y = (R+r)\cos t - r\cos\left(\frac{R+r}{r}t\right) \end{cases}$$

EPICYCLOIDAL BRUSHING SYSTEM

TECHNICAL FIELD

The present invention relates to the removal of particles from a substrate during the manufacture of electronic packages and particularly to a system and method for removing the particles through epicycloidal brushing.

BACKGROUND OF THE INVENTION

In the manufacturing process of an electronic package, the mounting of a chip (device) on a substrate, usually done through soldering, is called "first level packaging". This stage of the process needs to be performed in a "clean" environment to avoid that unwanted particles deposit on the module obtained, before the module is encapsulated, usually with a resin, and the circuits are protected by external agents. For this reason the whole process is carried on in a so-called "Clean Room", which according to industry standards must be at least of class 100000. This means that in a cubic meter there are no more than 100000 particles with dimension less than 3 $\mu$m. As an example, in IBM manufacturing lines the Clean Rooms are of class 30000.

Notwithstanding these precautions it can happen that particles of organic nature (eg. coming from a human body such as skin or hair) or of metallic nature (e.g. from moving mechanical machinery) deposit on the module.

The removal of the particles from the module, before the encapsulation is essential for the functionality of the final package. The presence of particles of any nature between the circuits of the substrate can be very harmful. This is particularly true if the increasing reduction of dimensions in the electronic standards is considered. What, in the past, used to be a "cosmetic" problem, with the reduced space between the circuit lines is becoming a vital requirement. It is likely that smaller and smaller particles will become more and more dangerous.

A technique which is normally used to remove the unwanted particles is to wash the modules with Perchlorethylene (PCE) which provides a grease removal. This technique, however does not give the assurance of a complete removal of the particles. For this reason, a manual check with the aid of microscopes must be performed afterwards and the residual particles manually removed with brushes and scrapers.

It should be immediately evident that the above described technique is very laborious and also not completely reliable, because of the human intervention. Furthermore, the interruption of the mechanical handling of the modules for the manual checking and refinement leaves open the eventuality of contamination during the waiting times and the moving of the modules.

It is an object of the present invention to provide a technique which overcomes the above drawbacks.

SUMMARY OF THE INVENTION

According to the present invention, we provide a brushing system for removing unwanted particles from the surface of a semiconductor device, the semiconductor device including but not limited to an electronic module or a substrate for receiving electronic modules, the system comprising:

brushing means for brushing said surface or said substrate with a rotating brush, the rotating brush describing a substantially epicycloidal movement.

Further, according to the invention we provide a brushing system for removing unwanted particles from electronic modules the system comprising:

a rotatable shaft having a cylindric bore and connectable to a motor, the bore being axially displaced with respect to the axis of rotation of the shaft;

a rotatable brush having a plurality of bristles and a cylindric hub extending into the bore of the shaft and being free to rotate inside the bore, said hub having substantially the same diameter of said bore.

Furthermore, according to the present invention we provide a method for mechanically removing unwanted particles from the surface of an electronic module, the method comprising the step of:

brushing the module with a rotating brush, the rotating brush describing a substantially epicycloidal movement.

BRIEF DESCRIPTION OF THE DRAWINGS

Various embodiments of the invention will now be described in detail by way of examples, with reference to accompanying figures, where.

DETAILED DESCRIPTION OF THE PREFERRED EMBODIMENT

The adhesion of a particle to a substrate is caused by a plurality of different forces. The main components of the adhesion force are: the Van der Waals force, which is the attraction any molecule or atom exercises on another molecule or atom; the electrical double layer force, which is caused by electrostatic contact potentials due to the differences in local energy states and electron work functions between two materials; the electrostatic image force, which is caused by bulk excess charges present on the surface which produce a coulombic attraction; and the capillary force, which is due to the humidity in the air.

It has been proved that, to overcome the resistance of all the above forces, a pressure would be needed from different directions in order to more effectively remove the particles from the substrate.

This multi-direction action can be easily realized by manually brushing the module, but it is very difficult to create an automatic movement which reproduces such action.

This is the reason which prevented the manual removal to be substituted by a more affordable and economic automatic process.

It has been discovered that an epicycloidal movement of a brush is theoretically a movement very close to the ideal one (i.e. with lateral pressure from different directions) and it is relatively easy to be mechanically reproduced.

Figure 1:
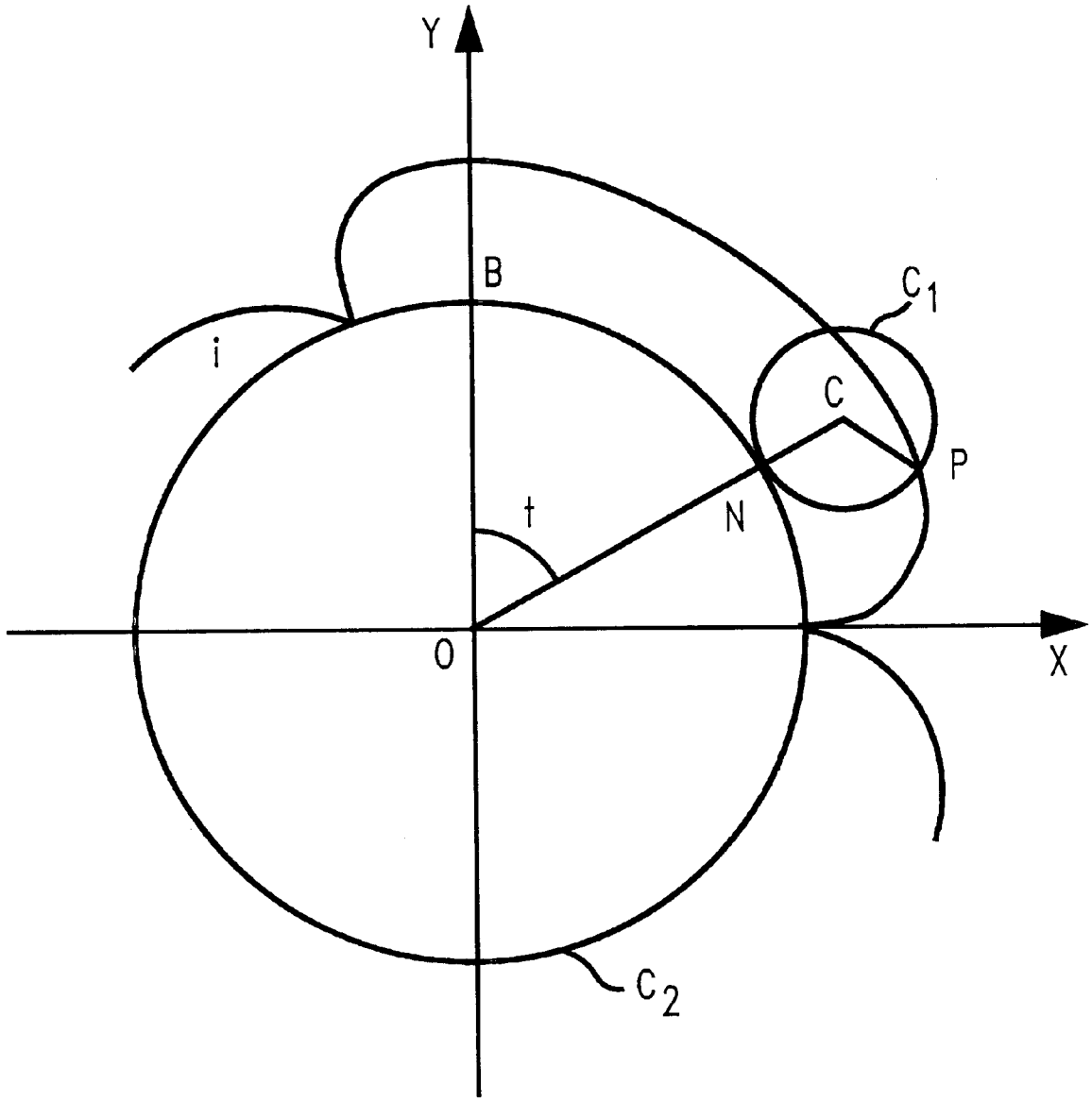
FIG. 1 shows schematically a classic epicycloidal curve.

FIG. 1 shows a classic epicycloidal movement which is equivalent to the curve described by a point P on a circumference $C_1$ with centre C and radius r=NC rotating, without sliding, on a circumference $C_2$ with centre O and radius R=ON. The point P can be compared to a single bristle on a rotatable brush.

Figure 2B:
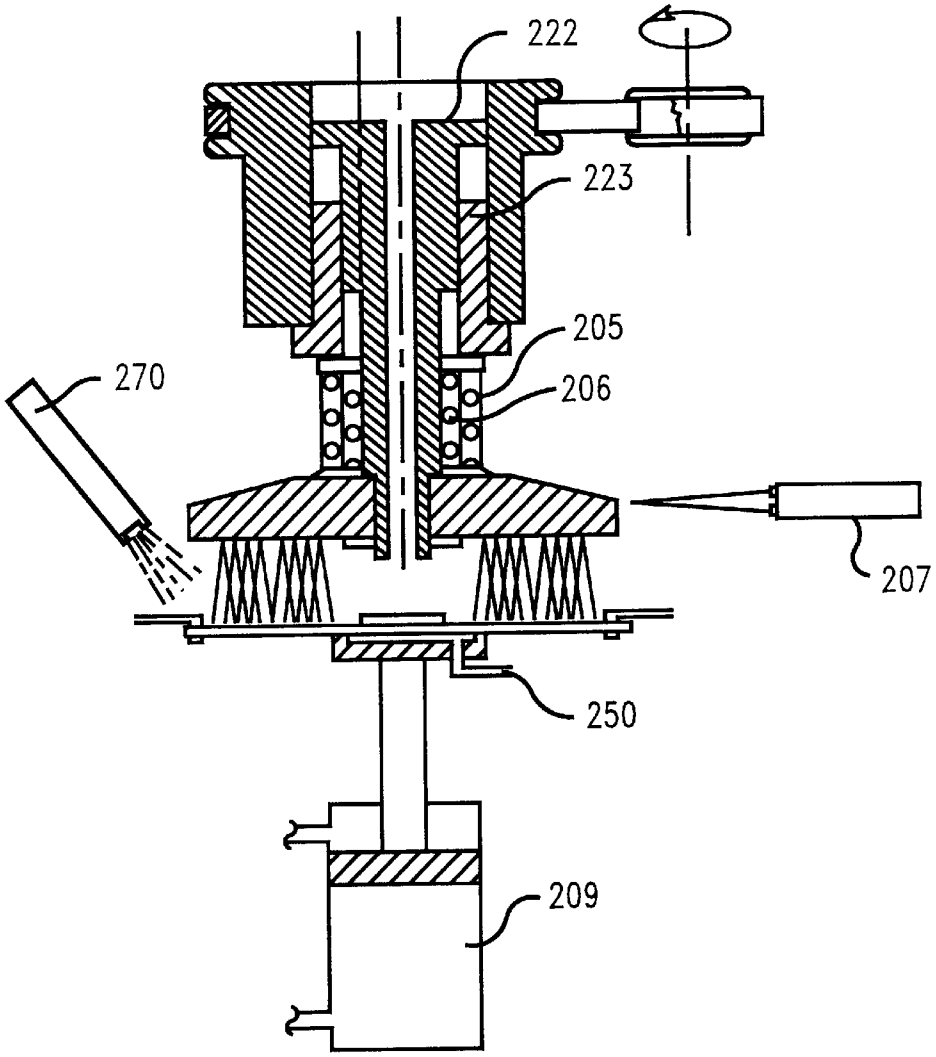
FIG. 2*b* shows the same embodiment while in operation.
Figure 2A:
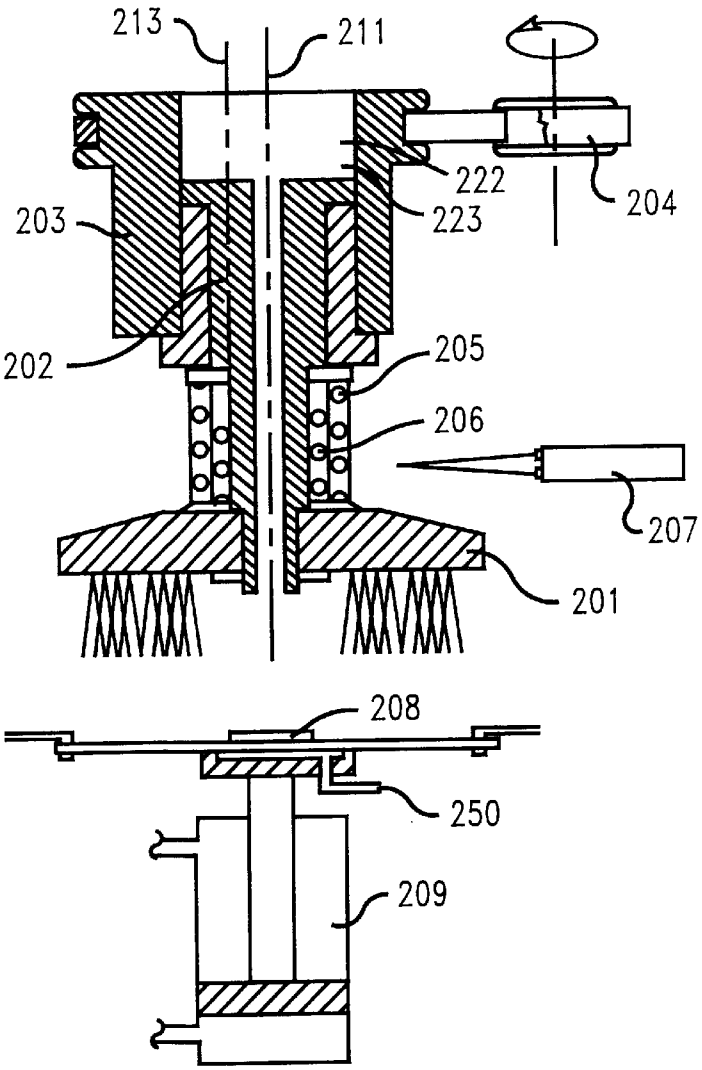
FIG. 2*a* shows schematically an embodiment of the present invention while not in operation.

FIG. 2 shows a rotating brush for cleaning electronic modules according to a preferred embodiment of the present invention, which realizes a substantially epicycloidal movement when the rotating brush comes in contact with the surface of the module to be cleaned.

With reference to FIG. 2, the circular brush 201 has a hub 202 with axis of rotation 211 which can freely rotate into the bore of the cylindric shaft 203. The cylindric shaft 203 is rotatable around an axis 213. The bore of the shaft is axially displaced with respect to the axis of rotation 213 of shaft 203; this causes the axis of rotation 211 of brush 201 to be eccentric with respect to the axis of rotation 213 of shaft 203. Motor 204 is coupled to cylindric shaft 203 and is able to make it rotate. In a preferred embodiment the radius of brush 201 is between 30 mm and 60 mm, the distance between the axis 211 and the axis 213 is 1.5 mm and the cylinder 203 has a rotation speed comprised between 1500 and 4000 rpm according to the dimension of brush 201.

According to a preferred embodiment, the hub 202 of the circular brush 201 is also able to move vertically along the axis 201 into the bore of the shaft 203. To limit this vertical movement and avoid the brush 201 sliding out from the bore of the shaft 203, the hub 202 has a rim 222 which engages the recess 223. Coil spring 205 forces the brush in its lowest position while not in operation. A second coil spring 206 more strongly resilient than the first one opposes the upward movement of the brush in the bore of the shaft beyond a certain threshold.

When cylinder 203 rotates and the bristles of brush 201 are free from friction, brush 201 will simply follow cylinder 203 in its rotation. When a surface (e.g. the surface of an electronic module) is brought into contact with the brush bristles, the friction will cause brush 201 to start looping on its own axis, describing epicycloidal curves. The orbit of the epicycloidal curves will depend from the strength of the friction.

In a preferred embodiment when the brushing system is rotating an elevator 209 brings an electronic module 208 in contact with the brush 201 and contrasts the opposition of coil spring 206. The spring 206 will determine the load of the brush on the module and, as mentioned above, the orbit of the epicycloidal curves. In a preferred embodiment the module is held in place by the elevator 209 by means of a vacuum 250.

An optical sensor 207 controls the elevator 209 stopping the elevation when the module reaches a predetermined position. Changing the adjustment of the sensor 207 the pressure of spring 206 will change causing a modification of the epicycloidal curves. This mechanism also allows to provide a constant pressure regardless of the wear and tear of the brush bristles.

With the action of the epicycloidal brushing described above, the particles on the module will be hit by the brush bristles from different directions and their adhesion forces will be overcome very effectively. The rotation of the brush will also cause the particles to be removed from the module before they can deposit in a different place on the module itself.

Figure 3:
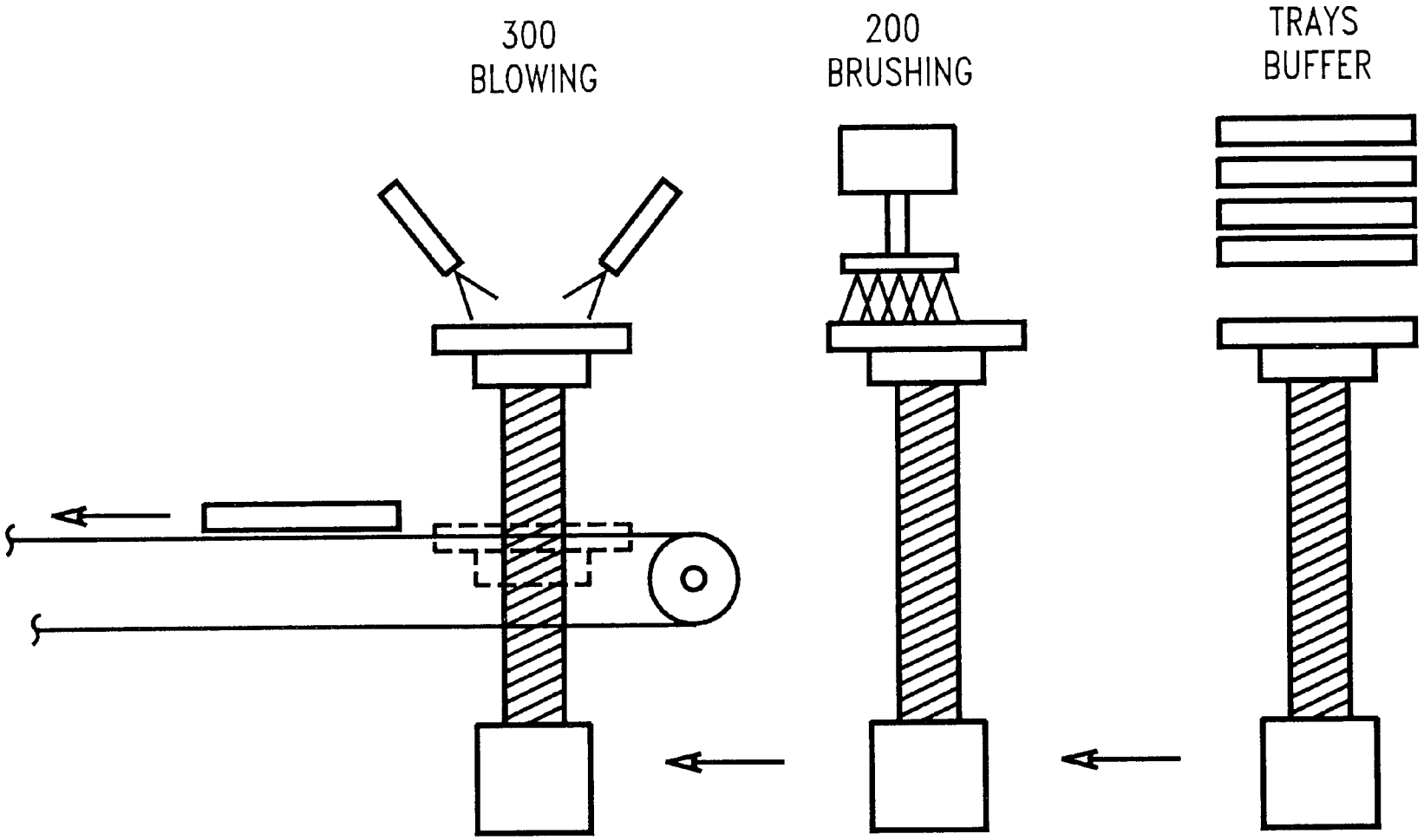
FIG. 3 shows the sequence of operations for brushing the module followed by removing the particles with an air blower.

According to a preferred embodiment in FIG. 3 an air blowing jet 300 coupled to an aspirator (not shown) can be provided for the brushing system 200 to ensure the highest level of cleanliness.

In a preferred embodiment the bristles of the brush 201 are made of natural materials (e. g. camel or wild boar hair). To avoid that harmful electrostatic charges, produced by the friction of the natural bristles with a dielectric material, could damage the electronic circuits of the module, a few conductive bristles (e.g. 0.06 mm brass wires) have been inserted. These conductive bristles should be shorter than the natural bristles (e.g. 3 mm shorter) otherwise they could scratch the module substrate. In a preferred embodiment, in order to further reduce the accumulation of electrostatic charges, an ionizer 270 (or a group of ionizers) is provided.

We claim:

1. A brushing system for removing unwanted particles from the surface of a semiconductor device, the system comprising:

a rotatable shaft having a cylindric bore and connectable to a motor, the bore being radially displaced with respect to the axis of rotation of the shaft; and a rotatable brush for brushing the surface, the brush having a plurality of bristles and a cylindric hub extending into the bore of the shaft, the hub being free to rotate inside the bore and able to move axially inside the bore, the hub having substantially the same diameter of said bore; and elastic means for opposing axial movement of the hub, thereby causing the brush to exert pressure against the surface when in contact therewith, wherein movement of the brush describes a substantially epicycloidal curve on the surface in accordance with the pressure exerted against the surface, so that a change in the pressure causes a change in the epicycloidal curve.

2. The system of claim 1 wherein the elastic means comprises a coil spring.

3. The system of claim 1 further comprising elevator means for bringing a semiconductor device in contact with the brush, the elevator means capable of opposing said elastic means.

4. The system of claim 3 further comprising sensor means for controlling said elevator means.

5. The system of claim 4 further comprising means for modifying the epicycloidal movement of the rotating brush whereby constant pressure is maintained by the rotating brush on the semiconductor device.

6. The system of claim 1 wherein the bristles of the rotatable brush comprise natural bristles.

7. The system of claim 6 wherein the natural bristles are interleaved by conductive wires.

8. The system of claim 7 wherein the conductive wires are shorter than the natural bristles.

9. The system of claim 6 further comprising an ionizer for preventing accumulation of electrostatic charges.

10. The system of claim 1 further comprising means for preventing redeposit of the unwanted particles on the semiconductor device.

11. The system of claim 10 wherein the preventing means comprises an air jet coupled to an aspirator.

* * * * *